US006267030B1

(12) United States Patent
Rodoni

(10) Patent No.: US 6,267,030 B1
(45) Date of Patent: Jul. 31, 2001

(54) TOOL COUPLER AND EXTENDER MECHANISM

(76) Inventor: Daniel H. Rodoni, 2520 Howe St., Santa Cruz, CA (US) 95065

( * ) Notice: Subject to any disclaimer, the term of this patent is extended or adjusted under 35 U.S.C. 154(b) by 0 days.

(21) Appl. No.: 09/480,532

(22) Filed: Jan. 7, 2000

(51) Int. Cl.[7] ..... B25G 1/04
(52) U.S. Cl. ..... 81/177.2; 81/177.2; 81/166
(58) Field of Search ..... 81/177.1, 177.2, 81/166

(56) References Cited

U.S. PATENT DOCUMENTS

| | | | | |
|---|---|---|---|---|
| D. 394,992 | | 6/1998 | Landin . | |
| 1,463,077 | * | 7/1923 | Gandell | 81/177.2 |
| 1,511,738 | * | 10/1924 | Lownsberry | 81/177.2 |
| 2,490,739 | | 12/1949 | Nesbitt . | |
| 4,104,935 | | 8/1978 | Stoops . | |
| 4,644,600 | * | 2/1987 | Fugate | 7/166 |
| 4,811,638 | * | 3/1989 | Kertzscher | 81/177.2 |
| 4,960,014 | | 10/1990 | Kelley . | |
| 5,535,649 | * | 7/1996 | Waggle | 81/177.2 |
| 5,832,794 | * | 11/1998 | Fowler | 81/177.2 |

* cited by examiner

*Primary Examiner*—Joseph J. Hail, III
*Assistant Examiner*—Daniel Shanley

(57) ABSTRACT

A tool coupler and extender mechanism for affording greater leverage on a wrench. The tool coupler and extender mechanism includes a coupling member having a generally flat first side and a generally flat second side and having a definite thickness and further having a plurality of tool retaining members integrally extending outwardly from the first side and being adapted to retain a wrench between themselves and the coupling member. The coupling member also has a boss securely and conventionally disposed upon the second side with the coupling member further having a bore extending through the boss and through the first side and being adapted to receive a drive member of a socket wrench.

1 Claim, 2 Drawing Sheets

TOOL COUPLER AND EXTENDER MECHANISM

BACKGROUND OF THE INVENTION

1. Field of the Invention

The present invention relates to a wrench torque aid device and more particularly pertains to a new tool coupler and extender mechanism for affording greater leverage on a wrench.

2. Description of the Prior Art

The use of wrench torque aid device is known in the prior art. More specifically, wrench torque aid device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,101,935; U.S. Pat. No. 4,960,014; U.S. Pat. No. 4,644,600; U.S. Pat. No. 2,490,739; U.S. Pat. No. 1,511,738; and U.S. Pat. No. Des. 394,992.

While these devices fulfill their respective, particular objectives and requirements, the aforementioned patents do not disclose a new tool coupler and extender mechanism. The inventive device includes a coupling member having a generally flat first side and a generally flat second side and having a definite thickness and further having a plurality of tool retaining members integrally extending outwardly from the first side and being adapted to retain a wrench between themselves and the coupling member. The coupling member also has a boss securely and conventionally disposed upon the second side with the coupling member further having a bore extending through the boss and through the first side and being adapted to receive a drive member of a socket wrench.

In these respects, the tool coupler and extender mechanism according to the present invention substantially departs from the conventional concepts and designs of the prior art, and in so doing provides an apparatus primarily developed for the purpose of affording greater leverage on a wrench.

SUMMARY OF THE INVENTION

In view of the foregoing disadvantages inherent in the known types of wrench torque aid device now present in the prior art, the present invention provides a new tool coupler and extender mechanism construction wherein the same can be utilized for affording greater leverage on a wrench.

The general purpose of the present invention, which will be described subsequently in greater detail, is to provide a new tool coupler and extender mechanism which has many of the advantages of the wrench torque aid device mentioned heretofore and many novel features that result in a new tool coupler and extender mechanism which is not anticipated, rendered obvious, suggested, or even implied by any of the prior art wrench torque aid device, either alone or in any combination thereof.

To attain this, the present invention generally comprises a coupling member having a generally flat first side and a generally flat second side and having a definite thickness and further having a plurality of tool retaining members integrally extending outwardly from the first side and being adapted to retain a wrench between themselves and the coupling member. The coupling member also has a boss securely and conventionally disposed upon the second side with the coupling member further having a bore extending through the boss and through the first side and being adapted to receive a drive member of a socket wrench.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tool coupler and extender mechanism which has many of the advantages of the wrench torque aid device mentioned heretofore and many novel features that result in a new tool coupler and extender mechanism which is not anticipated, rendered obvious, suggested, or even implied by any of the prior art wrench torque aid device, either alone or in any combination thereof.

It is another object of the present invention to provide a new tool coupler and extender mechanism which may be easily and efficiently manufactured and marketed.

It is a further object of the present invention to provide a new tool coupler and extender mechanism which is of a durable and reliable construction.

An even further object of the present invention is to provide a new tool coupler and extender mechanism which is susceptible of a low cost of manufacture with regard to both materials and labor, and which accordingly is then susceptible of low prices of sale to the consuming public, thereby making such tool coupler and extender mechanism economically available to the buying public.

Still yet another object of the present invention is to provide a new tool coupler and extender mechanism which provides in the apparatuses and methods of the prior art some of the advantages thereof, while simultaneously overcoming some of the disadvantages normally associated therewith.

Still another object of the present invention is to provide a new tool coupler and extender mechanism for affording greater leverage on a wrench.

Yet another object of the present invention is to provide a new tool coupler and extender mechanism which includes a coupling member having a generally flat first side and a generally flat second side and having a definite thickness and further having a plurality of tool retaining members integrally extending outwardly from the first side and being adapted to retain a wrench between themselves and the coupling member. The coupling member also has a boss securely and conventionally disposed upon the second side with the coupling member further having a bore extending through the boss and through the first side and being adapted to receive a drive member of a socket wrench.

Still yet another object of the present invention is to provide a new tool coupler and extender mechanism that easily and quickly allows the user to loosen stuck fasteners.

Even still another object of the present invention is to provide a new tool coupler and extender mechanism that eliminates slippage on the wrench as is commonly found with makeshift extensions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
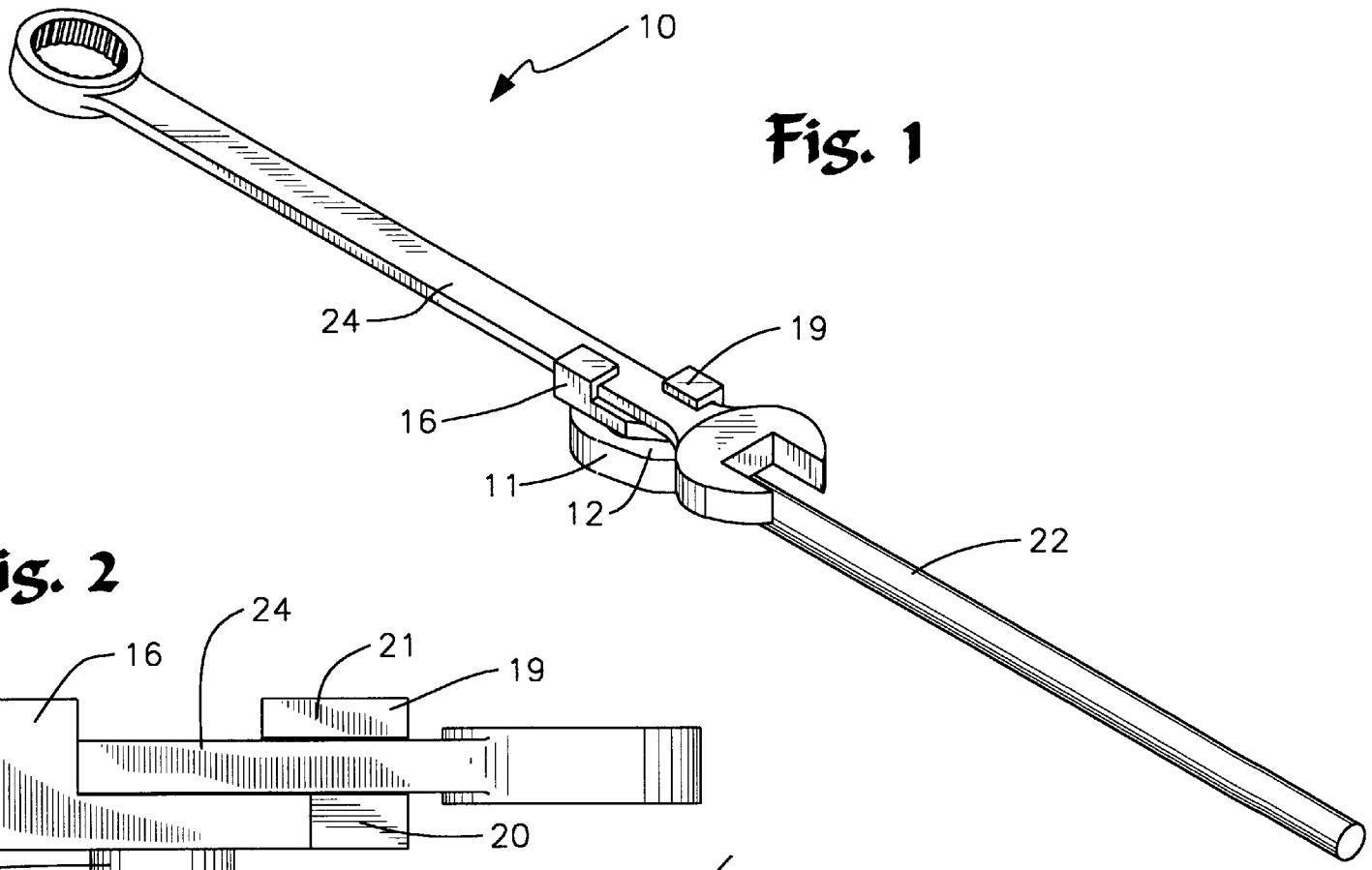
FIG. 1 is a perspective view of a new tool coupler and extender mechanism according to the present invention and being used.
Figure 2:
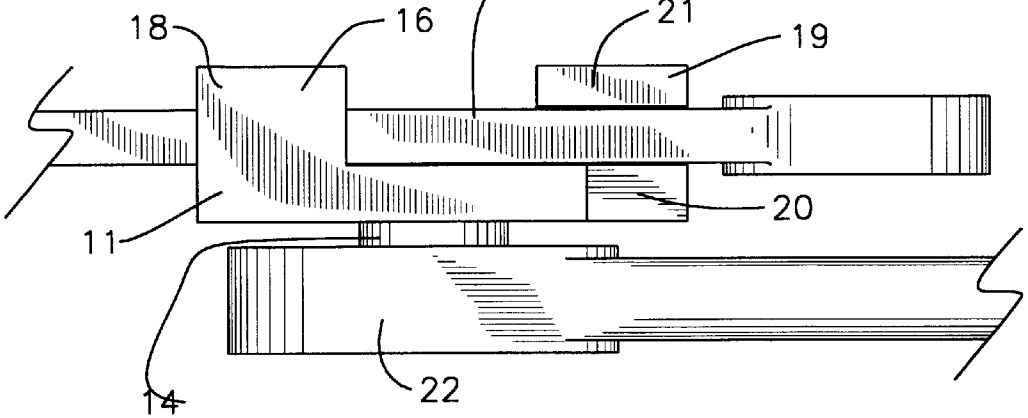
FIG. 2 is a elevational view of the present invention.
Figure 3:
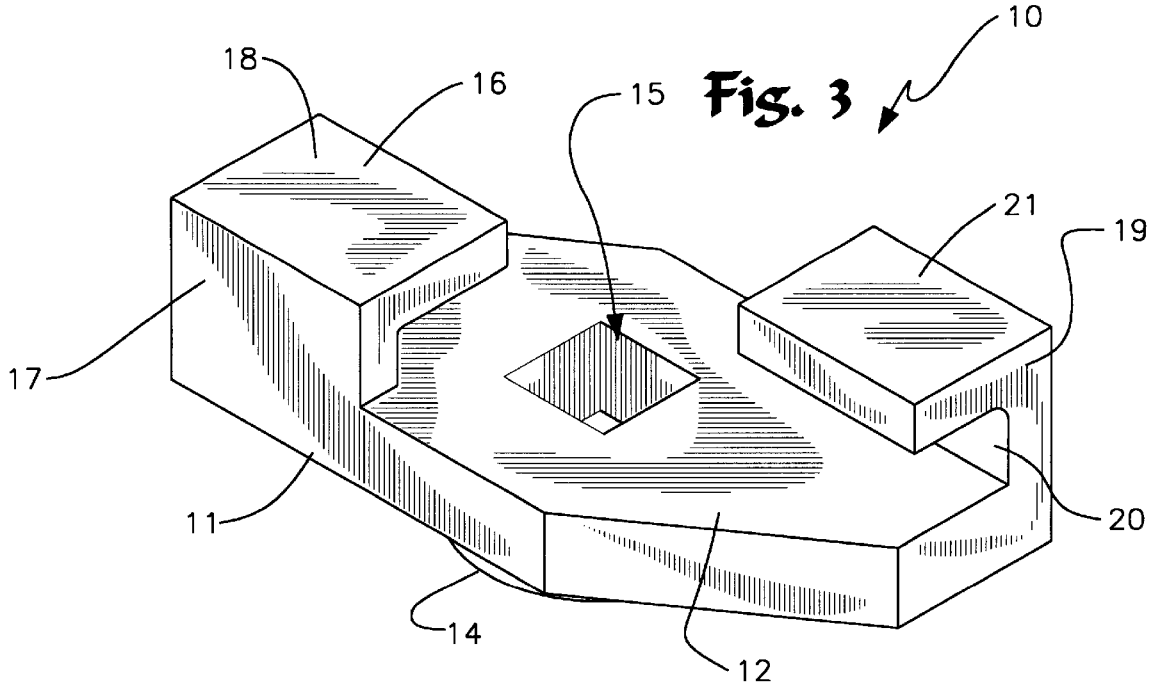
FIG. 3 is a first side perspective view of the present invention.
Figure 4:
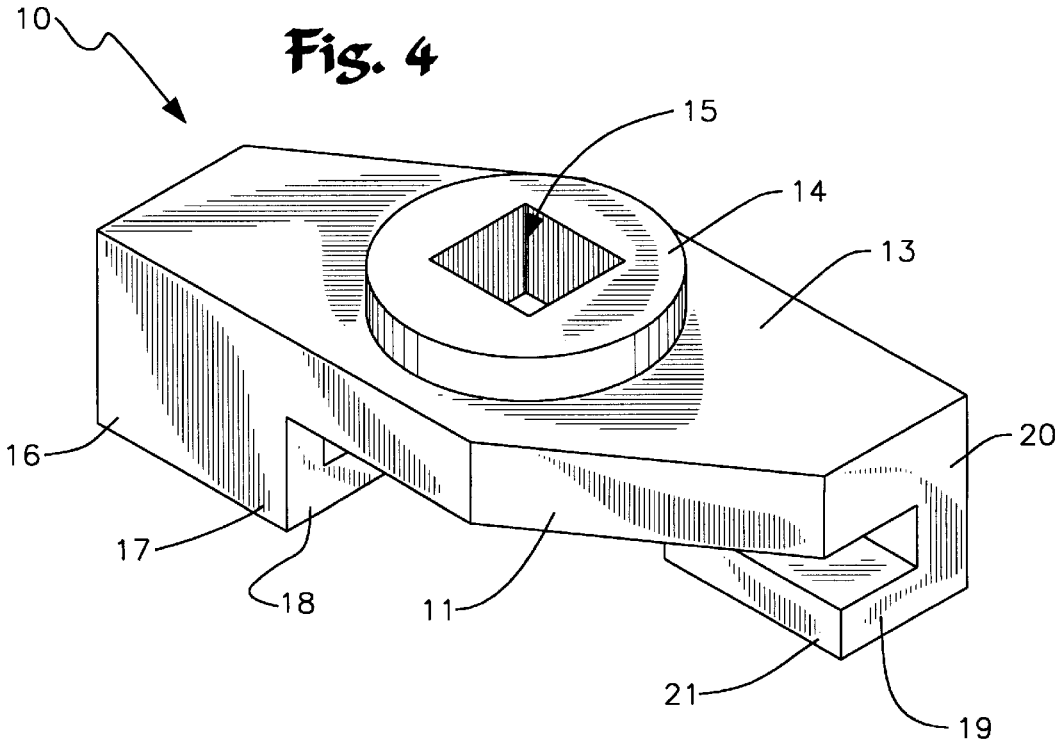
FIG. 4 is a second side perspective view of the present invention.

With reference now to the drawings, and in particular to FIGS. 1 through 4 thereof, a new tool coupler and extender mechanism embodying the principles and concepts of the present invention and generally designated by the reference numeral 10 will be described.

As best illustrated in FIGS. 1 through 4, the tool coupler and extender mechanism 10 generally comprises a coupling member 11 having a generally flat first side 12 and a generally flat second side 13 and having a definite thickness and further having a plurality of tool retaining members 16,19 integrally extending outwardly from the first side 12 and being adapted to retain a wrench 24 between themselves and the coupling member 11. The coupling member 11 also has a boss 14 securely and conventionally disposed upon the second side 13 with the coupling member 11 further having a bore 15 extending through the boss 14 and through the first side 12 and being adapted to receive a drive member of a socket wrench 22. Each of the tool retaining members 16,19 includes a first portion 17,20 and a second portion 18,21 which is angled relative to the first portion 17,20. The first portion 17,20 is integrally attached to the coupling member 11 and is disposed generally perpendicular to the first side 12 of the coupling member 11. The second portion 18,21 is disposed above and generally parallel to the first side 12 of the coupling member 11 thus forming a space therebetween with the space being adapted to receive a portion of a wrench 24. The coupling member 11 also includes a first end, a second end, a first side edge and a second side edge. A first one of the tool retaining members 16 is disposed along a portion of the first side edge at the first end. A second one of the tool retaining members 19 is disposed along a portion of the second side edge at the second end. The bore 14 is centrally disposed through the coupling member II with the coupling member 11 having a length of about 2¾ inches to about 3¼ inches.

In use, the inserts the drive member of a socket wrench 22 in the bore 14 through the second side 13 of the coupling member 11 and also inserts a wrench between the second portions 18,21 of the tool retaining members 16,19 and the first side 12 of the coupling member 11 with the socket wrench 22 and the wrench 24 being essentially coupled together and with the wrench 24 actually being extended as a result so that torque can be applied to the wrench 24 in taking off or putting on a nut or bolt to a particular object.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool coupler for coupling a socket wrench to a wrench for increasing torque applied by the wrench to a fastener, said tool coupler comprising:

a coupling member having a generally flat first side and a generally flat second side and having a definite thickness and further having a plurality of tool retaining members integrally extending outwardly from said first side for gripping a wrench between themselves and said coupling member, said coupling member also having a boss securely disposed upon said second side, said coupling member further having a bore extending through said boss and through said first side with a substantially rectangular shape adapted to receive a drive member of a socket wrench, each of said tool retaining members including a first portion and a second portion which is angled relative to said first portion, said first portion being integrally attached to said coupling member and being disposed generally perpendicular to said first side of said coupling member, said second portion being disposed above and generally parallel to said first side of said coupling member thus forming a space for receiving a portion of a wrench in a manner permitting slidable positioning of said coupling member along an entire length of the handle portion between the web portions for adjusting the amount of torque provided to the wrench, said coupling member including a first end, a second end, a first side edge and a second side edge, a first one of said tool retaining members being disposed along a portion of said first side edge at said first end and a second one of said tool retaining members being disposed along a portion of said second side edge at said second end, said bore being centrally disposed through said coupling member.

* * * * *